United States Patent [19]

Frechette

[11] 4,049,110

[45] Sept. 20, 1977

[54] PRINT WHEEL MOUNTING ASSEMBLY

[75] Inventor: Kenneth R. Frechette, Dallas, Tex.

[73] Assignee: Xerox Corporation, Stamford, Conn.

[21] Appl. No.: 691,264

[22] Filed: May 28, 1976

[51] Int. Cl.[2] ..... B41J 1/30

[52] U.S. Cl. ..... 197/53; 197/18; 403/373

[58] Field of Search ..... 101/93.19; 197/18, 52–55; 285/318–320; 403/345, 373

[56] References Cited

U.S. PATENT DOCUMENTS

| | | | |
|---|---|---|---|
| 1,670,017 | 5/1928 | Berman | 403/373 X |
| 2,805,089 | 9/1957 | Hansen | 285/320 X |
| 2,825,080 | 3/1958 | Bongiovanni | 403/373 X |
| 3,856,336 | 12/1974 | Karcher et al. | 285/318 X |
| 3,878,929 | 4/1975 | Orlens et al. | 197/18 X |

*Primary Examiner*—Edgar S. Burr
*Assistant Examiner*—Paul T. Sewell

[57] ABSTRACT

A print wheel mounting assembly for a daisy type print element comprising a generally circular disc section coupled to the hub of the print element, a generally cylindrical section, an end cap section pivotally coupled to the cylindrical section and having a shaft portion extending at right angles therefrom and back toward the hub of the print element and a coil spring positioned around the generally cylindrical section with the end portions positioned such that when the shaft portion of the end cap is inserted therebetween, the coil spring is tightened around the generally cylindrical portion to clamp the print element firmly to the shaft of the print element motor.

4 Claims, 4 Drawing Figures

PRINT WHEEL MOUNTING ASSEMBLY

BACKGROUND OF THE INVENTION

This invention relates, in general, to print elements and more particularly to a mounting assembly for a daisy wheel print element employed in serial printers.

The Diablo Corporation, a subsidiary of the present assignee, is marketing a serial printer under the tradename of Diablo Hytype I, which employs a movable carriage with a daisy type print wheel, print hammer and ribbon cartridge mounted thereon. A printer of this type is disclosed in a U.S. patent application filed Sept. 4, 1973, in the name of Andrew Gabor, Ser. No. 394,072, abandoned, entitled "High-Speed Printer with Intermittent Print Wheel and Carriage Movement", being a continuation of an application filed Feb. 25, 1972, Ser. No. 229,314, abandoned, the disclosure of which is incorporated by reference into this specification.

The Diablo Hytype I printer is enjoying commercial success as a serial printer in such applications as communication terminals, computer output devices, etc. However, in certain type applications, such as automatic text-editing typewriter applications in the office environment, additional features and capabilities are desired, e.g., higher print quality. In the text-editing or office-typing environment, the demands for high print quality cause the print wheel to be subjected to about ten times greater force due to about five times greater hammer energy compared to a Hytype I printer operating as a computer output terminal, for example.

A modified model of the Hytype I printer is employed as the printing mechanism of the commercially available Xerox 800 Electronic Typing System for automatic text-editing typewriter applications in the office environment. To provide the high print quality needed, the integrally molded thermoplastic print wheel of the Hytype I printer was replaced by a composite print wheel such as that disclosed in a U.S. patent application, filed Sept. 25, 1974, in the name of Gordon Sohl et al, Ser. No. 509,193 abandoned. In addition, a different print hammer assembly was incorporated therein which provided greater hammer energy. A card guide was added to the carriage to provide assistance in the operation of inserting and aligning paper in the automatic textediting typewriter. The Diablo Hytype I ribbon cartridge containing a fabric ribbon was replaced by a ribbon cartridge containing a matrix-type plastic ribbon from which a higher quality of printed material may be obtained.

In the environment provided by the modified printer, the spacings between the paper, ribbon and composite print wheel are extremely close because of the modifications (addition of a card guide and the thicker character slugs of the new composite print wheel) to the printer. The additional weight and inertia of the composite print wheel make the mounting of the print wheel more important than the mounting of the prior art print wheel or element. When it is necessary to change the print wheel on the printer to another print wheel, it is important to be able to easily and positively remove the print wheel and attach the replacement print wheel so that neither print wheel is damaged.

With these requirements in mind, it is a primary object of the present invention to design a simple and reliable means for mounting a print element in a serial printer.

Another object of this invention is to provide an improved print element mounting assembly.

Yet, another object of the current invention is to design a print element mounting assembly which provides a tightening force around the shaft of the print element motor.

Other objects and advantages of the present invention will be evident from the specification and claims when read in conjunction with the accompanying drawing illustrative of the invention.

SUMMARY OF THE INVENTION

In accordance with the principles illustrative of this invention, the foregoing objects and others of the present invention are accomplished by a print wheel mounting assembly comprising a generally circular disc section coupled to the hub or central section of the print wheel. A generally cylindrical section is coupled at one end to the circular disc section. Both the disc section and the cylindrical section have a central opening, coaxially aligned, for positioning the sections onto the smooth shaft of the print element motor. An end cap section is pivotally coupled to one edge portion of the other end of the cylindrical section and has a portion which extends, in a radial direction, beyond the outer periphery of the cylindrical and has a shaft portion extending at right angles therefrom and back toward the hub of the print wheel.

The shaft portion has three different sections with the first section being a cylindrical section, followed by a tapered section which increases in circumference and then another tapered section which decreases in circumference and ending in a point.

A coil spring is positioned around the cylindrical section with the end portions extending radially therefrom in a spaced-apart relation.

The spaced-apart end portions are positioned opposite the shaft portion of the end cap such that when the end cap is pushed back toward the hub of the print wheel, the shaft portion spreads the end portions of the spring apart. This spreading action results in the spring tightening around the cylindrical section to clamp and hold the print wheel to the shaft of the print wheel motor. The tapered sections of the shaft provide for easy insertion between the end portions of the spring and provide a locking function because of the detent action to maintain the clamping action during printing operation.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1:
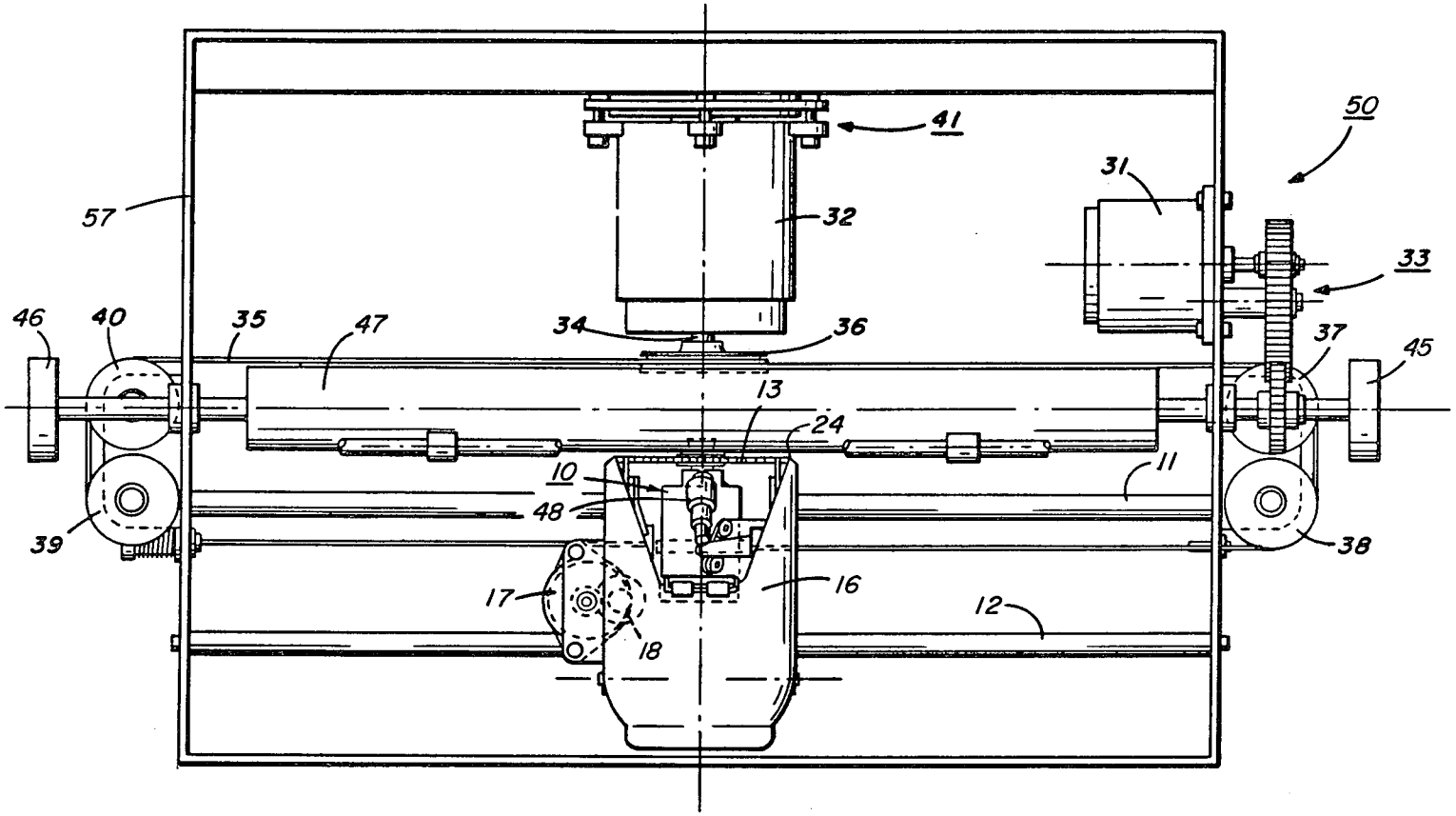
FIG. 1 is a top plan view of a printer embodying the present invention as viewed by the operator.

Referring now to the drawing and more particularly to FIG. 1, an overall view of the printer embodying the present invention is illustrated. Mounted on a base frame 57 is a platen 47 with knobs 45 and 46 for rolling the platen 47 and paper record medium (not shown) wrapped thereon. A carriage 10 is mounted for linear movement on the carriage mounting rails 11 and 12 bridged between opposite sidewalls of the base frame 57 of the printer 50. Carriage 10 includes a rotary print wheel 13 on which are a number of type elements or character slugs, a hammer-type impact printing mechanism 48 for striking a selected type element, a ribbon cartridge 16 having an inked ribbon 24 interposed between the paper on the platen 47 and the type element on the print wheel 13 located at the print position or station and a ribbon advance motor 17 as best shown in FIG. 2.

Furthermore, there are a stepping motor 31 and a servo motor 32 mounted on the base frame 57. The stepping motor 31 is coupled to the platen 47 by a gear train 33 so that the platen 47 is indexed when the motor 31 is activated to incrementally advance the paper through the printer 50. The servo motor 32, on the other hand, has one end of its drive shaft 34 coupled to the carriage 10 by a cable 35, which is trained around a series of pulleys 36-40, and the other end of its drive shaft 34 coupled to a shaft encoder 41. Thus, the carriage 10 is moved to translate the printing mechanism 48 lengthwise of the platen 47 when the servo motor 32 is actuated, while the encoder 41 supplies a signal which is representative of the actual position of the carriage 10 at any given time.

Figure 2:
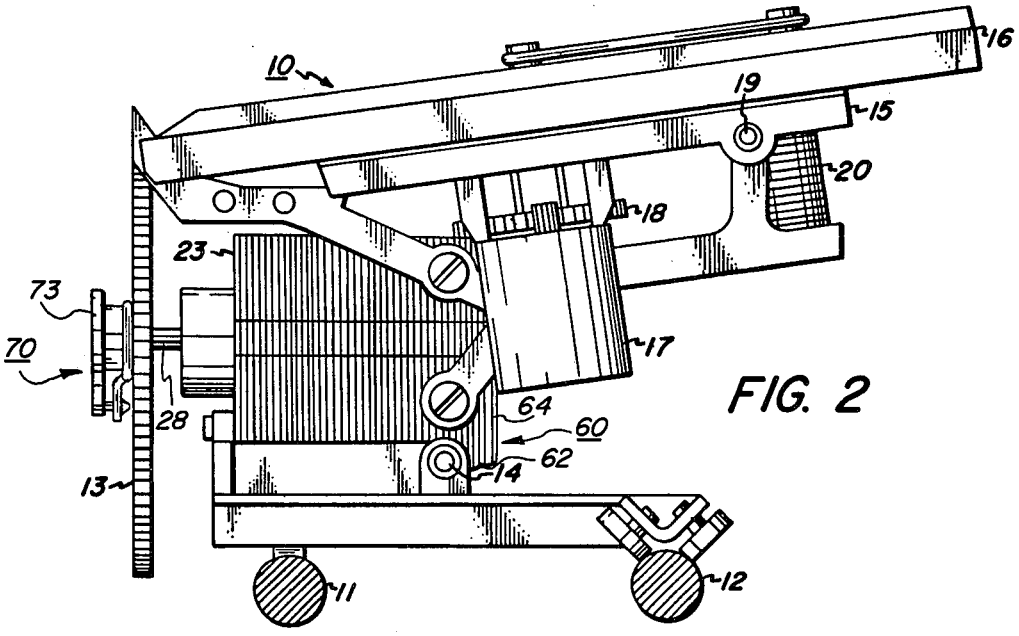
FIG. 2 is a side plan view of the carriage of the printer of FIG. 1.

With reference to FIG. 1 and 2 and the printer carriage 10 mounted for linear movement on the mounting rails 11 and 12, as typing of the printed characters occurs, the carriage 10 stops each time a character is to be printed. Also, while the carriage 10 is moving from one location to the next location along rails 11 and 12 by moving the cable 35, the print wheel 13 is rotated such that the next character to be printed will be in position at the print position or station when the carriage 10 stops and the printing mechanism 48 is fired. As seen in FIG. 2, the upper portion of carriage 10 is pivotable clockwise about shaft 14 with respect to the lower portion of carriage 10. This pivoting motion is necessary in order to bring the print wheel 13 up into a position such that the print wheel may be exchanged for a different print wheel.

The ribbon cartridge mounting plate 15 provides the mounting structure for the ribbon cartridge 16, the ribbon advance motor 17 and the ribbon advance gearing 18. The ribbon cartridge mounting plate 15 is pivotable clockwise, in FIG. 2, about shaft 19. This pivoting motion is necessary to raise the ribbon from the down position, which is the position that allows the printed material to be viewed by the operator, to the up position at the print station when printing is to occur. The force to pivot the ribbon cartridge mounting plate 15 is a magnetic force supplied by electromagnet coils 20. When coils 20 are energized, that portion of the ribbon cartridge mounting plate 15 above coils 20 is drawn down toward the coils thereby raising that portion of the ribbon cartridge 16 which is nearest the print wheel 13 to the print position.

Still referring to FIGS. 1 and 2, carriage 10 also includes a motor 23 having a smooth shaft 28. Mounting on one end of the shaft is the rotary print wheel 13. Wheel 13 includes the print wheel mounting assembly 70 which allows the wheel 13 to be easily removed from the shaft 28 and, for example, replaced with another wheel with, for example, a different font of characters. The other end of shaft 28 has mounted thereon a transducer 60 which provides position signals related to the rotary positions of the shaft and, therefore, the print wheel 13. Transducer 60 includes a fixed disc 62 adjacent a disc 64 mounted for rotation with the shaft 28. Electrical interaction between these two discs 62 and 64 produce the position signals which are used in a servo system for controlling the print wheel 13. Consequently, when motor 23 is activated with the necessary signal, the print wheel 13 is rotated as necessary to bring any selected one of its character slugs 2 into alignment with the hammer printing mechanism 48 for printing out the selected character. Additionally, the transducer 60 supplies a continuously updated signal which is representative of the actual position of the print wheel 13.

Figure 3:
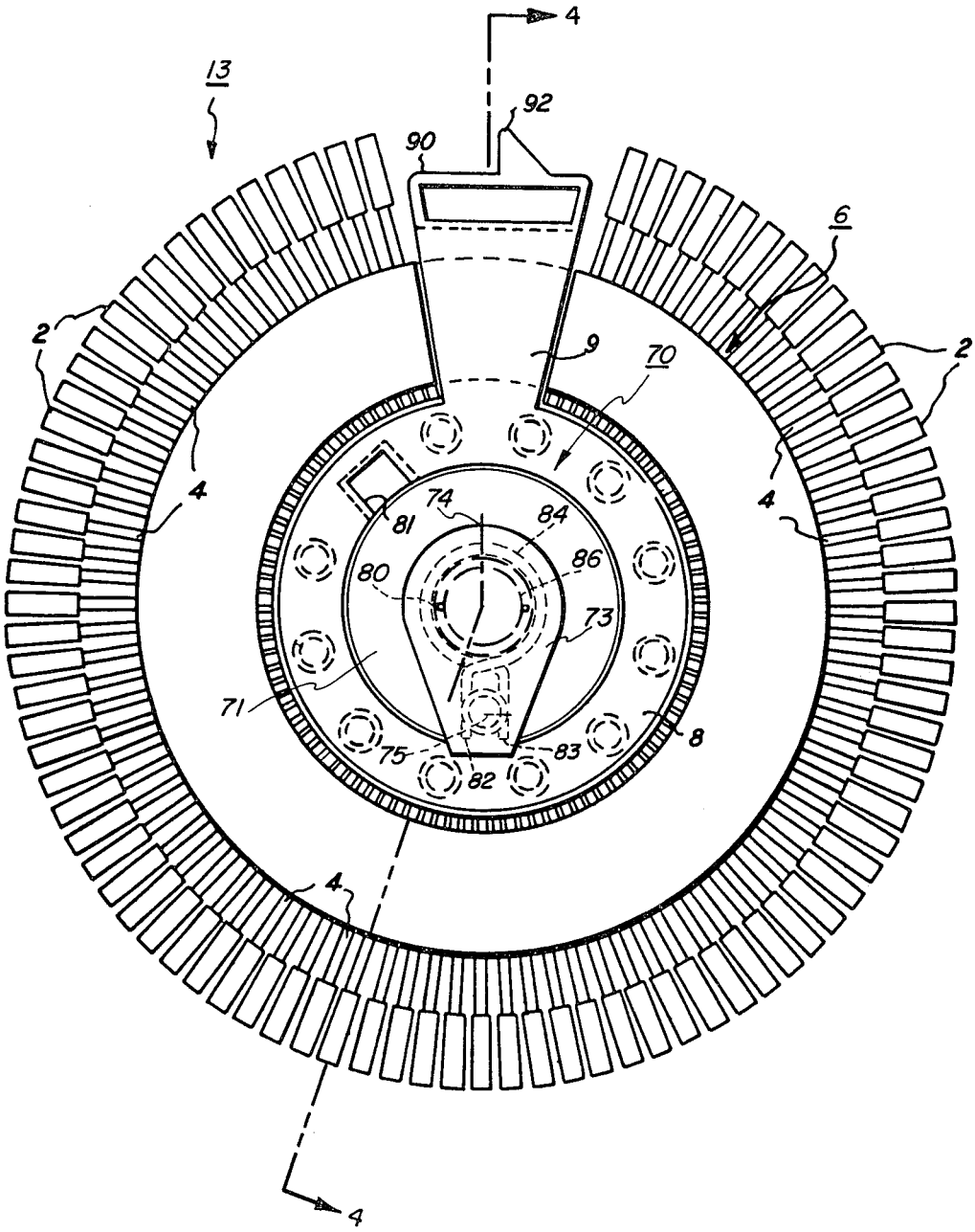
FIG. 3 is a plan view of the composite print wheel embodying the present invention.
Figure 4:
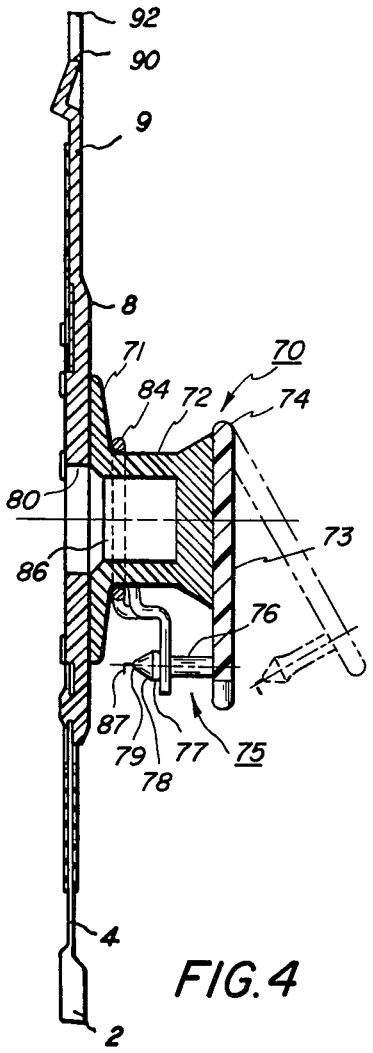
FIG. 4 is a plan elevation view of the composite print wheel in FIG. 3.

FIG. 4 is a vertical section taken along the line 4—4 in FIG. 3 of the print wheel mounting assembly 70 with the print wheel mounting assembly shown in solid line in it's "closed" or "locked" position and in phantom line in it's "open" or "unlocked" position.

With reference to FIGS. 3 and 4, one embodiment of the present invention is shown in its mounted position relative to the print wheel. The print wheel 13 is a composite structure being made up of several components, the most prominent of which are the spokes or beams 4 with the character slugs 2 molded onto the ends thereof and the hub 8 riveted to the center of the wheel with its flag 9 extending outwardly amidst the spokes 4. Another component includes a damper 6 mounted over the spokes 4 to alter their deflection properties. Hole 80, in the center of hub 8, allows attachment of print wheel 13 to shaft 28 of print wheel motor 23. The alignment of print wheel 13 to shaft 28 is provided by the key-way of notch 81.

The flag 9 is integral with hub 8, being fabricated with the hub as a unit in an injection molding process. The flag 9 is a truncated pie-shaped element whose width increases with radii unlike spokes 4 which have a fixed width over their length. The outer end of the flag 9 including a straight edge 90, which underlines the line of characters being printed. When the ribbon 24 is in the down position, which allows the operator to view the printed material, the top edge of the ribbon is approximately even with the straight edge 90. At the very end of the flag 9 is the pointer 92, which is a vertical reference mark to help the operator to visually align the eye to the printing position.

The print wheel mounting assembly 70 comprises a generally circular disc section 71 coupled to hub 8 and positioned on the side of the print wheel 13 containing the print surface of the character slug 2. Circular disc section 71 lies in a plane parallel to a plane formed by hub 8. A generally cylindrical section 72 is coupled at one end to disc section 71 and extends outwardly perpendicular to hub 8. An end cap section 73 is pivotally coupled to cylindrical section 72 by hinge means 74 and is capable of pivoting toward and away from hub 8. Detent shaft 75 extends at approximately right angles from the end cap section 73 and is positioned on that portion of the end cap section which extends out beyond the periphery of the cylindrical section 72. When the end cap section 73 is pivoted toward hub 8 until it is flush with the end of the cylindrical section 72, which will be denoted as the closed or locked position, detent shaft 75 lies approximately parallel to cylindrical section 72.

Detent shaft 75 has basically three sections. A cylindrical section 76 is coupled to the end cap section 73 and extends back toward hub 8. Coupled to the cylindrical section 76 is a tapered section 77 which increases in the peripheral dimension as the section progresses away from end cap section 73 for a predetermined distance. Coupled to tapered section 77 is another tapered section 78 which decreases in the peripheral dimension as the section progresses away from end cap section 73. Tapered section 78 diminishes to essentially a point 79.

A coil spring 84 having at least one turn is wound around the outside periphery of cylindrical section 72. Spring ends 82 and 83 extend outwardly at right angles from cylindrical section 72 and are positioned such that when end cap section 73 is pivoted to the closed position, detent shaft 75 forces the spring ends apart and thereby tightens the spring 81 around the cylindrical section 72. The dimensions and relationship among spring ends 82 and 83 and detent shaft 75 is such that when end cap section 73 is in the closed position, spring ends 82 and 83 rest on the tapered section 77. This positioning assures a force being continually applied to spring ends 82 and 83 which forces the spring ends apart; thereby, providing a firm mounting of print wheel 13 to the print wheel motor shaft 28.

In a further embodiment of the print wheel mounting assembly 70, a right angle extension 87 is provided at the point 79 of tapered section 78. The right angle extension 87 comprises a section which is coaxial with the cylindrical section 76 of detent shaft 75 and coupled thereto is a short section positioned at right angles to the cylindrical section 76. Extension 87 assures that during the movement of the end cap section 73 from the closed to open positions, etc., detent shaft 75 will maintain alignment with the opening between spring ends 82 and 83.

Disc section 71 and cylindrical section 72 each have a central opening 86, coaxially aligned, which is of a value larger in diameter than shaft 28 so that print wheel 13 (with the print wheel mounting assembly 70 coupled thereto) may be easily slipped on shaft 28 with a loose fit resulting when the print wheel mounting assembly 70 is in the open or unlocked position (detent shaft 75 is not in the inserted position between spring ends 82 and 83). Hub 8 rests against a mounting plate (not shown) coupled to print wheel motor shaft 28. The print wheel mounting assembly 70 is formed of rubber. When the print wheel mounting assembly 70 is closed by rotating end cap section 73 to the closed position and the spring tightens around cylindrical section 72, cylindrical section 72 clamps around shaft 28 and firmly holds print wheel 13 to shaft during the printing operation.

To remove the print wheel 13 from shat 28, end cap section 73 is pivoted away from hub 8 thereby opening or unlocking the print wheel from shaft 13. End cap section 73 is then held by the fingers to remove the print wheel 13 from shaft 28 and also to provide a convenient "handle" to use during the installation and removal of the print wheel 13.

It will be appreciated that there has been shown an illustrative arrangement for use in a print wheel impact printer to provide for an easy and positive mounting assembly for a daisy type print element that fully satisfies the objects, aims and advantages set forth above. While the principles of the invention have been made clear in the illustrative embodiment, it is apparent that alternatives, modifications and variations will be evident to those skilled in the art. Accordingly, it is intended to embrace all alternatives, modifications and variations as fall within the spirit and broad scope of the appended claims.

What is claimed is:

1. In a daisy wheel print element having a plurality of spokes extending radially outward from a central section, character slugs having a print surface and an impact surface and coupled to the ends of the spokes, said central section having an opening centered therein for mounting the print element on a shaft of a print wheel motor; an improved print element mounting assembly comprising:

a generally circular disc section having a central opening and being coupled to the central sectin and positioned coaxially with the opening in the central section, a generally cylindrical section having a central opening and being coupled at one end to the generally circular disc section and positioned coaxially with the opening in the central section, a coil spring having at least one turn positioned around the periphery of the generally cylindrical section, said coil spring having two end portions which extend radially from the generally cylindrical section and are spaced apart a predetermined distance, means for tightening the spring around the generally cylindrical section, said tightening means having an end cap section pivotally coupled to one edge portion of the end of the generally cylindrical section which is positioned furthest from the central section in an axial direction, said end cap section having a portion which extends in a radial direction beyond the outer periphery of the generally cylindrical section, said extended portion having a shaft extending at right angles therefrom back toward the central section of the print wheel, said shaft having a cylindrical section coupled to a tapered section increasing in peripheral distance which is coupled to a tapered section decreasing in peripheral distance, said end cap section being positioned such that the shaft is capable of being inserted between the two end portions of the coil spring to spread the end portions apart, whereby the print wheel is clamped to the shaft of the print wheel motor.

2. The improvement of claim 1 wherein said disc section and said cylindrical section include rubber.

3. The improvement of claim 1 wheren said end cap section includes rubber.

4. The improvement of claim 1 wherein said end cap section includes a guide pin whereby said shaft remains in alignment with the opening between the end portions of the spring when in the unlocked position.

* * * * *